US005303495A

United States Patent [19]

Harthcock

[11] Patent Number: 5,303,495

[45] Date of Patent: Apr. 19, 1994

[54] PERSONAL WEAPON SYSTEM

[76] Inventor: Jerry D. Harthcock, 1301 N. Denton Dr., Carrollton, Tex. 75006

[21] Appl. No.: 987,788

[22] Filed: Dec. 9, 1992

[51] Int. Cl.[5] ..... F41A 9/62

[52] U.S. Cl. ..... 42/84; 42/1.02; 42/70.11

[58] Field of Search ..... 42/84, 70.11, 1.01, 42/1.02

[56] References Cited

U.S. PATENT DOCUMENTS

| | | | |
|---|---|---|---|
| 439,055 | 10/1890 | Von Dérschau | 42/84 |
| 2,597,212 | 5/1952 | White et al. | 42/1.01 |
| 3,580,113 | 5/1971 | Ramsay et al. | 42/84 |
| 3,631,623 | 1/1972 | Platt | 42/84 |
| 3,650,174 | 3/1972 | Nelson | 42/84 |
| 3,748,770 | 7/1973 | Mitchell | 42/84 |
| 3,854,231 | 12/1974 | Broyles | 42/84 |
| 3,914,996 | 10/1975 | Davis et al. | 42/1.01 |
| 3,982,347 | 9/1976 | Brandl et al. | 42/84 |
| 4,015,531 | 4/1977 | Ziemba | 102/70.2 |
| 4,145,584 | 3/1979 | Otterlei | 361/398 |
| 4,285,153 | 8/1981 | Crouch | 42/84 |
| 4,324,060 | 4/1982 | Lawrence | 42/84 |
| 4,332,098 | 6/1982 | Estenevy | 42/84 |
| 4,354,189 | 10/1982 | Lemelson | 42/70.11 |
| 4,433,890 | 2/1984 | Marino et al. | 29/866 |
| 4,457,091 | 7/1984 | Wallerstein | 42/70.11 |
| 4,467,545 | 8/1984 | Shaw | 42/70.11 |
| 4,541,191 | 9/1985 | Morris et al. | 42/1.01 |
| 4,563,827 | 1/1986 | Heltzel | 42/70 |
| 4,601,243 | 7/1986 | Ueda et al. | 102/200 |
| 4,621,578 | 11/1986 | Vallieres et al. | 102/202.9 |
| 4,730,407 | 3/1988 | DeCarlo | 42/84 |
| 4,763,431 | 8/1988 | Allan et al. | 42/70.11 |
| 4,883,457 | 11/1989 | Sibalis | 604/20 |
| 4,890,094 | 12/1989 | Kopel | 340/571 |
| 5,005,307 | 4/1991 | Horne et al. | 42/1.02 |
| 5,016,376 | 5/1991 | Pugh | 42/70.11 |
| 5,022,175 | 6/1991 | Oncke et al. | 42/70.11 |
| 5,033,217 | 7/1991 | Brennan | 42/1.01 |
| 5,052,138 | 10/1991 | Crain | 42/1.02 |
| 5,061,830 | 10/1991 | Ambrose | 200/5 A |
| 5,062,232 | 11/1991 | Eppler | 42/70.11 |
| 5,074,189 | 12/1991 | Kurtz | 89/135 |
| 5,083,392 | 1/1992 | Bookstaber | 42/84 |
| 5,142,805 | 9/1992 | Horne et al. | 42/1.02 |
| 5,192,818 | 3/1993 | Martin | 42/84 |
| 5,196,828 | 3/1993 | Keniston | 42/1.13 |
| 5,217,014 | 6/1993 | Hahn et al. | 128/640 |

*Primary Examiner*—David H. Brown
*Attorney, Agent, or Firm*—Johnson & Gibbs

[57] ABSTRACT

A personal weapon system comprises a microprocessor-controlled and electronically fired "blow-forward" handgun with a firing parameter memory device, digital security lock and safety device, directional compass, electronic rounds counter, integral keyboard and liquid crystal display, laser designator capability, programmable piezo-resistive trigger, and high frequency A.C. ignitable primer. A microprocessor receives information from a real time clock, Hall-effect rounds counter, and an integral Hall-effect compass. The processor displays this information on the LCD display for the operator. When a round is fired, the microprocessor records time and date, number of rounds fired, and direction of firing for crime lab analysis. The trigger pressure required to fire the handgun is programmable by the operator, and a corresponding trigger detonation mark is displayed on the LCD display. Trigger pressure exerted by the operator is displayed on the LCD display as a bar graph which lengthens in proportion to trigger pressure applied. The weapon fires when the bar graph reaches the trigger detonation mark.

23 Claims, 6 Drawing Sheets

PERSONAL WEAPON SYSTEM

BACKGROUND OF THE INVENTION

1. Field of the Invention

The invention relates to a personal weapon system, and more particularly, to a microprocessor-controlled and electronically fired "blow-forward" handgun with a firing parameter memory device, programmable piezo-resistive trigger, and high frequency A.C. ignitable primer.

2. History of the Prior Art

Guns and rifles have always been, in effect, "dumb" weapons. That is, they have traditionally been unable to provide weapon-firing information to law enforcement officers for crime lab reconstruction. Following a crime involving a conventional handgun or rifle, investigators may be able to match a gun to the crime through ballistics matching if a bullet is found at the scene, but all other information concerning a shooting is lost or must be painstakingly pieced together from extrinsic evidence, with a good deal of guesswork and uncertainty. Investigators need to be able to reconstruct crimes in terms of the number of shots fired, time and date of firing, and direction of each shot fired. It would be a distinct advantage for crime lab reconstruction to have a gun which sensed and stored such information for later retrieval and analysis.

Another limitation of conventional guns and rifles is their use of mechanical firing and safety mechanisms consisting of simple mechanical linkages Which enable or disable travel of the trigger and hammer. Such mechanical linkages may be either mechanically or electrically actuated. Typically, the safety mechanisms of conventional guns are designed to prevent only unintentional firings of the gun by knowledgeable operators. Generally, such safety mechanisms are not able to prevent unintentional firing by people who are not knowledgeable of the operation of the gun, such as children. Children may unknowingly release a safety mechanism, or may release the mechanism in play, believing that the gun is not loaded. Thus, existing safety mechanisms have led to numerous tragedies involving accidental shootings. Additionally, existing safety mechanisms have not been able to prevent unauthorized personnel from firing the gun. When a gun is stolen, for example, it becomes a deadly weapon in the hands of a criminal.

Several existing safety systems have attempted to solve this problem by providing mechanisms which block the mechanical action of the gun until a security code is entered. For example, U.S. Pat. No. 5,022,175 to Oncke et al discloses an external safety system which may be plugged into a handgun for the entry of a security code. U.S. Pat. No. 4,563,827 to Heltzel discloses an external safety system with a transmitter which sends a security code to a handgun to either mechanically arm or disarm the weapon. All of these existing systems are very complex. A simple safety system, built into the weapon itself, is needed.

It should also be noted that safety mechanisms on conventional guns have been known to fail and allow the gun to discharge when the gun is subjected to a sudden impact, such as dropping the gun to the ground. It would be a distinct advantage to have a gun which cannot be fired by anyone other than a knowledgeable, authorized operator, and which will not discharge due to sudden impacts.

Some existing handguns incorporate mechanisms to count the number of ammunition rounds remaining in the clip or magazine and display this information to the operator. The sensing mechanisms are generally mechanical mechanisms which are complex, subject to mechanical failures such as sticking, and add significant additional weight to the handgun. The displays for such mechanisms are generally strap-on displays which are attached to the side of an existing handgun. The operator, therefore, must take his/her eye off the sights and the target in order to read the display and ascertain the number of rounds remaining. This may be a grave disadvantage, for example, to a soldier in battle, a police officer in hot pursuit of armed criminals, or a competitive shooter in a rapid-fire shooting match. It would be a distinct advantage to have a gun or rifle with an electronic rounds counter which is highly reliable, adds very little or no weight to the gun, and which incorporates a display which is integrated into the structure of the gun, directly below the sight. The operator would not have to shift his/her gaze off of the sight or target in order to ascertain the number of rounds remaining in the magazine.

An additional problem with conventional guns and rifles is that they do not provide a way to program the amount of trigger pressure necessary to activate the weapon, nor do they advise the operator of the amount of pressure remaining before firing. A trigger pressure which is too heavy or too light can affect both safety and accuracy of the weapon. An extremely light setting, for example, may result in a "hair trigger" which can be dangerous if the operator is not aware of the setting. Inaccuracies occur when the trigger setting does not match the trigger setting which is preferred or anticipated by the operator because most inaccuracies are a result of the human/trigger interface. When the gun fires with a trigger pressure lighter than expected, or if the operator must squeeze harder than expected, accuracy can be adversely affected. It would be advantageous to have a gun or rifle which provides the capability for each individual operator to program the amount of trigger pressure necessary to activate the weapon, and which advises the operator of the amount of pressure remaining before firing. This capability would improve weapon safety and accuracy.

Conventional guns and rifles are also limited in their ability to program the number of rounds fired in each burst in an automatic mode, nor can they program the delay between individual rounds in a burst. For military purposes, it is sometimes desirable to fire a handgun or rifle in an automatic mode in short bursts of 2 or 3 rounds. Military automatic handguns suffer from a recoil effect in which the muzzle of the gun is deflected upward after each round is fired. In the automatic mode, this deflection grows more pronounced as the length of the burst increases and more rounds are fired. Generally, only the first 2 or 3 rounds are accurately fired, and the remaining rounds in the burst are wasted. It would be desirable to have an automatic handgun which enabled the operator to program the number of rounds to be fired in each burst, which reduced the recoil effect experienced by conventional military handguns, and which would automatically delay the firing of subsequent rounds until the handgun sensed that the operator had overcome the recoil effect and returned the handgun to its original line of fire.

SUMMARY OF THE INVENTION

In one aspect, the present invention is a firearm having a plurality of sensors located at various positions within the firearm. The firearm also has a means for controlling the functions of the sensors, and a means for communicating the output of the sensors to the controlling means. The firearm may also have a non-volatile memory device for storing the output of the sensors. In one embodiment, the controlling means is a microprocessor, and the sensors comprise a real-time clock and a Hall-effect compass. The firearm may also include an operator input device and an information output device which may be a keyboard and a liquid crystal display respectively.

In another aspect, the present invention is a personal weapon system comprising a firearm controlled by a microprocessor. The firearm comprises means within the firearm for storing a plurality of rounds of ammunition and means for firing the rounds of ammunition. The firearm also includes means connected to the microprocessor for providing time, date, and muzzle-pointing azimuth information, as well as means for recording this information for each of the rounds of ammunition fired.

In another aspect, the present invention is a microprocessor-controlled handgun having a plurality of rounds of ammunition, a rear side having an upper portion, and an internal microprocessor. The handgun comprises a blow-forward barrel which is propelled forward by exploding gases and friction from one of the rounds of ammunition as it travels through the barrel. An operator interface area forms the upper portion of the rear side of the handgun and comprises a keyboard and a liquid crystal display for operator interface with the internal microprocessor.

In yet another aspect, the present invention is a method of manufacturing an electrical circuit for a microprocessor-controlled firearm having a frame and a plurality of system components. The method comprises the steps of providing a single piece of mylar substrate; etching electrical conductors onto the mylar substrate to connect the system components; die-cutting the mylar substrate; surface-mounting the system components on the die-out substrate; and folding the die-cut mylar substrate to fit within the frame of the firearm.

BRIEF DESCRIPTION OF THE DRAWING

The invention will be better understood and its numerous objects and advantages will become more apparent to those skilled in the art by reference to the following drawing, in conjunction with the accompanying specification, in which.

DETAILED DESCRIPTION

Figure 1:
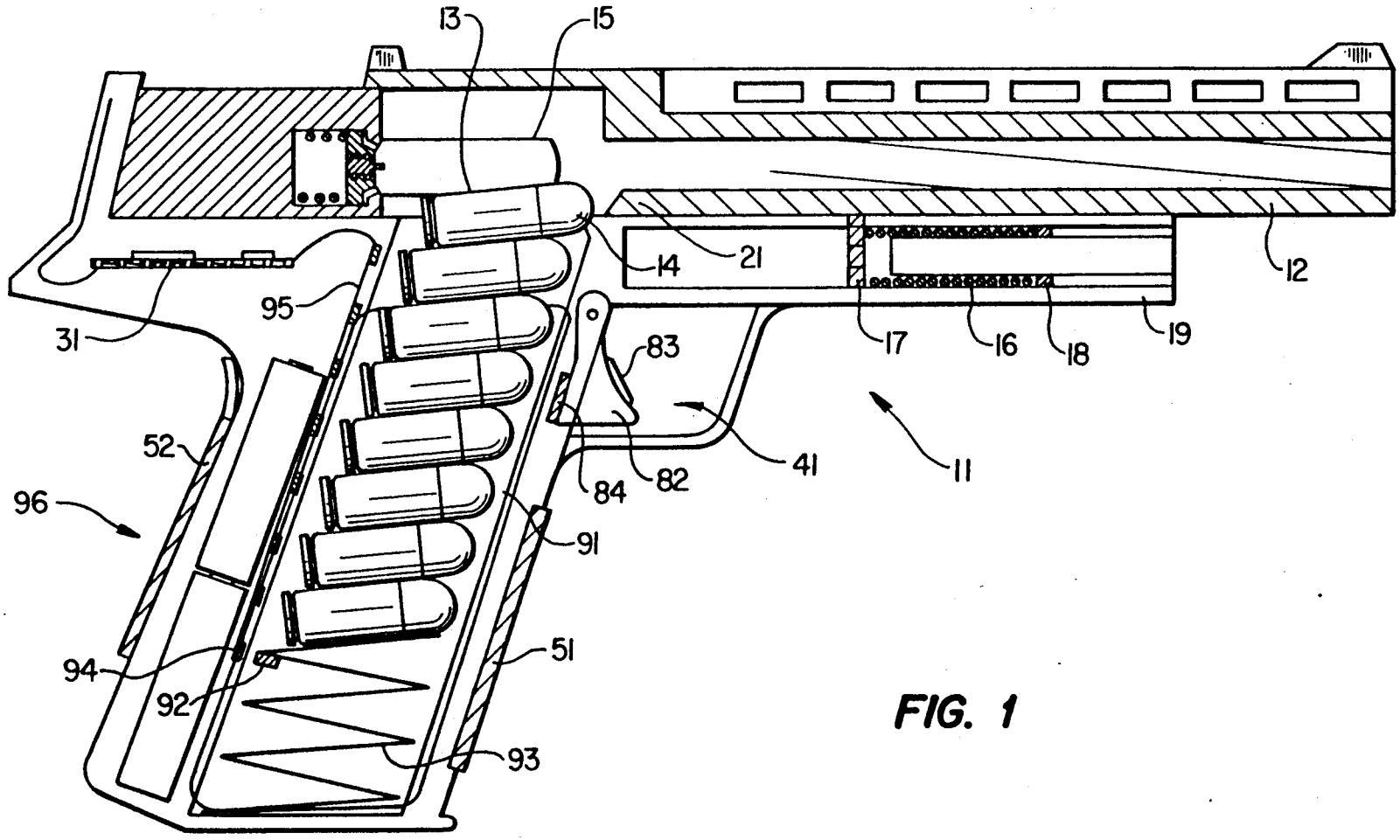
FIG. 1 is a right side cross-sectional view of one embodiment of a weapon system constructed in accordance with the principles of the present invention, and having the breech blown forward (open)

The personal weapon system of the present invention may be embodied in any type of personal firearm such as a handgun, a shotgun, or a rifle. Referring first to FIG. 1, it may be seen that the preferred embodiment of the present invention is a handgun of "blow forward" design. FIG. illustrates the handgun 11 with its barrel 12 in the forward (open) position. When a cartridge 13 is fired, barrel 12 is blown forward by expanding gas pressure and friction of the projectile 14 through the barrel 12. As the barrel moves forward, the empty cartridge 13 is ejected through an ejection port 15 located on the right-hand side of the handgun 11.

When the barrel 12 is blown forward, a slide spring 16 is compressed between a slide guide 17 and a retainer 18. The slide guide 17 is fixed to the barrel 12, and retainer 18 is fixed to a gun frame 19. Therefore, the forward movement of the barrel 12 compresses the slide spring 16. The compressed slide spring 16 forces the barrel 12 to rebound to the closed breech position, as shown in the left-side view of FIG. 2. During rebound, a new cartridge is pulled into the breech position by a lower wedge 21 (FIG. 1) of the barrel 12.

Figure 2:
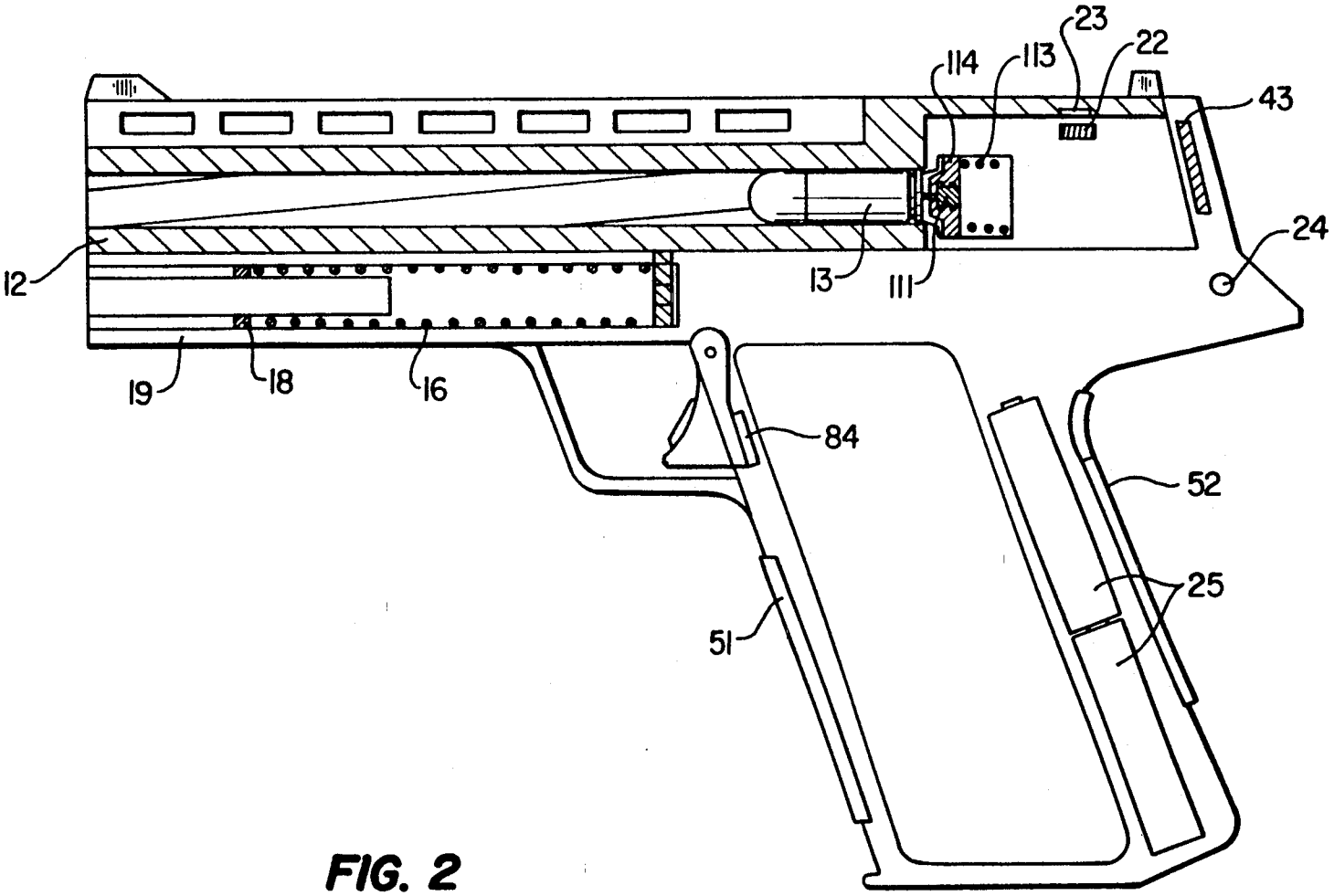
FIG. 2 is a left side cross-sectional view of one embodiment of a weapon system constructed in accordance with the principles of the present invention, and having the breech closed.
Figure 3:
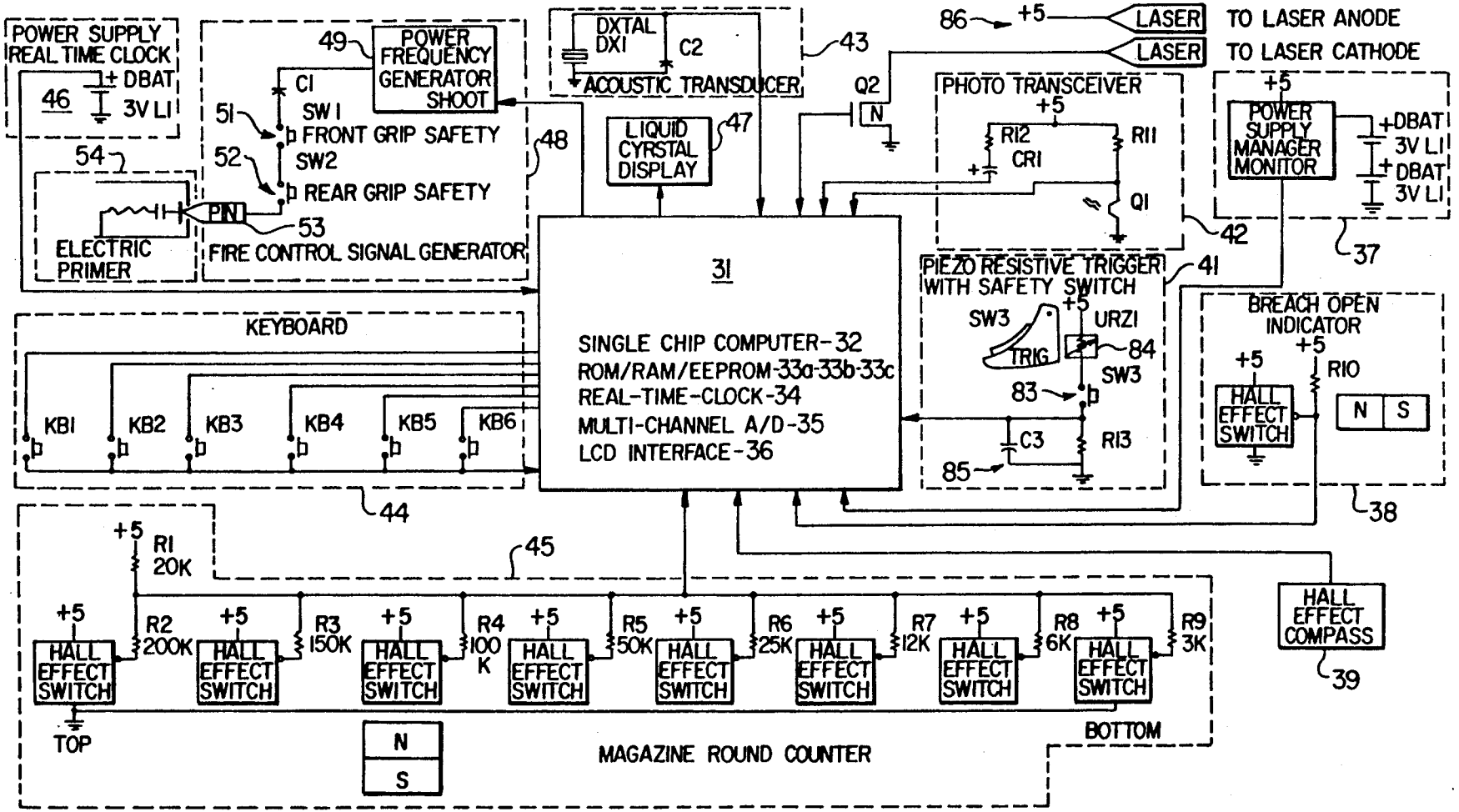
FIG. 3 is a schematic block diagram of the electrical system installed in the weapon system of the present invention.

FIG. 2 is a left side cross-sectional view of one embodiment of a weapon system constructed in accordance with the principles of the present invention, and having the breech closed. A number of sensors are distributed within the weapon, and communicate their outputs to a weapon system control processor 31 (FIG. 3). One such sensor is a "breech open" sensor 38, one embodiment of which is formed by a Hall-effect transistor 22 and a permanent magnet 23. "Hall effect" refers to the generation of an electric potential perpendicular to an electric current flowing along a thin conducting material upon the application of an external magnetic field. When the barrel 12 is in the blown forward position, an open breech condition is sensed because the magnet 23 is not directly over the Hall-effect transistor 22. When the barrel 12 returns to the closed position, the magnet 23 aligns itself directly over the Hall-effect transistor 22 and a closed breech condition is sensed. A signal indicating the position of the breech is transmitted to the weapon system control processor 31 which allows a firing signal to be generated only if the breech is closed. The control processor 31 is discussed in more detail below.

FIG. 2 also shows an embodiment of a photo transceiver port 24. Digital information is transmitted and received optically through the photo transceiver port 24. The port 24 is used to transfer setup parameters such as an owner's driver's license number, home address, and initial digital key look combination. These setup parameters may be stored in the handgun of the present invention by a gun dealer at time of purchase. The port is also used to download firing parameter information, stored in a non-volatile memory by the weapon system control processor 31, for crime lab reconstruction. This storing function is described in more detail below.

FIG. 2 also shows a preferred location for a weapon system power source 25, which may comprise two 3.0-volt lithium batteries. Placing the power source 25 in the rearmost part of the weapon serves to counter-balance the weight of the barrel 12, and provide a more balanced handgun 11 which is less fatiguing to operate.

FIG. 3 is a schematic block diagram of the electrical system installed in the weapon system of the present invention. A weapon system control processor 31 controls all functions of the handgun, and comprises a single chip microprocessor 32, which may be, for example, one of the 370-series of microprocessors from Texas Instruments, Inc. The microprocessor 32 includes a read only memory device (ROM) 33*a*, a random access memory device (RAM) 33*b*, an electrically erasable programmable read only memory device (EEPROM) 33*c*, a real time clock 34, a multi-channel analog-to-digital (A/D) converter 35, and a liquid crystal display (LCD) interface 36. The ROM 33*a* provides permanent storage of the weapon system's operational software program. The RAM 33*b* provides a working memory area for the operational software program. The EEPROM 33*c* provides a non-volatile memory area for the storage of firing parameter data such as time, date, and direction of firing, as well as setup parameters such as an owner's driver's license number, home address, and initial digital key lock combination.

It can be seen that the control processor 31 receives input signals from a power supply manager monitor 37, a breech open indicator 38, a Hall-effect compass 39, a piezo-resistive trigger with safety switch 41, a photo transceiver 42, an acoustic transducer 43, a keyboard 44, a magazine rounds counter 45, and a power supply and real time clock 46.

The control processor 31 sends signals to a LCD display 47 to provide operating and status information to the weapon system operator. The control processor 31 sends a firing signal to a fire control signal generator 48 which comprises a power frequency generator 49, a capacitor C1, a front grip safety switch 51, a rear grip safety switch 52, and an electronic firing mechanism 53. If the front grip safety switch 51 and the rear grip safety switch 52 are closed, a high frequency A.C. firing signal may be transmitted from the power frequency generator 49 to an electric primer circuit 54 in a loaded round 13 (FIG. 2). When the handgun is fired, the control processor 31 stores firing parameters, such as time and date of firing, number of rounds fired, and direction of firing, in the non-volatile EEPROM 33*c*. This logged information may be downloaded in a crime lab through the photo transceiver 24 for post crime reconstruction.

Referring again to FIG. 2, a piezoelectric acoustic transducer 43 is shown. The acoustic transducer 43 detects sound and more particularly, motion. By the use of on-chip A/D converters 35 in the control processor 31, the control processor monitors the acoustic transducer 43 for a "report" or explosion thus indicating whether or not the current round 13 was successfully discharged. In addition, the control processor 31 monitors the transducer 61 in real-time to determine if the weapon has recovered from recoil to its original line of firing. The control processor 31 optionally uses this information in controlling the time when the next round is fired when the handgun is set to the burst or fully automatic mode.

Figure 4:
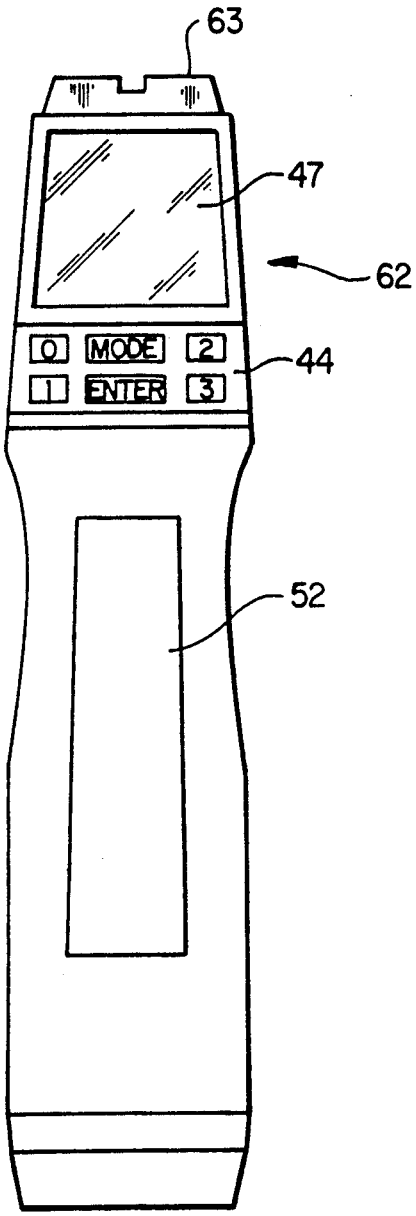
FIG. 4 is a back side elevational view of the weapon system of the present invention showing the operator interface area.

FIG. 4 is a back side elevational view of the weapon system of the present invention showing the operator interface area 62. Included in the operator interface area 62 is an information input device which may be, for example, a LCD display 47, and an operator input device, which may be a keyboard 44. Since the weapon system of the present invention is a "blow forward" handgun, there is no hammer as is found on a conventional handgun of "blow back" or "recoil" design. Therefore, the LCD display 47 and keyboard 44 may be located on the rear of the handgun 11, just below the rear sight 63. This position allows the operator to view the information on the LCD display 47 without having to move his/her gaze away from the area of the sight 63 or the target. Also shown in FIG. 4 is the rear grip safety switch 52. Pressure must be applied to this switch, along with the front grip safety switch 51 (FIG. 1) in order for the firing signal from the power frequency generator 49 to reach the electric primer circuit 54 (FIG. 3).

Figure 5:
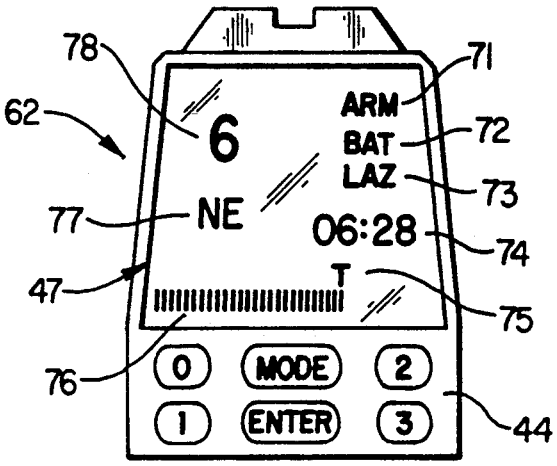
FIG. 5 is an illustration of the operator interface panel showing typical information displayed on the weapon system display panel when the weapon system is armed.

FIG. 5 is an illustration of the operator interface area 62 showing typical information displayed on the LCD weapon system display panel 47 when the weapon system is armed. Shown on the display 47 is an indication that the weapon is armed and ready 71, a low battery indicator 72, laser enable indicator 73, time 74, trigger detonation mark 75, trigger pressure bar graph 76, muzzle-pointing azimuth direction 77, and rounds remaining indicator 78. All indications are continuously updated by the weapon control processor 31. Muzzle-pointing azimuth direction is generated by the Hall-effect compass 39 (FIG. 3) and transmitted to the control processor 31. The LCD display 47 is lighted for the operator at night.

At the bottom of the LCD display 47, a bar graph 76 indicates the amount of pressure remaining to be exerted on the weapon's trigger mechanism 41 (FIG. 1) before the weapon fires. In the schematic diagram of FIG. 3, it may be seen that the trigger mechanism 41 comprises a trigger 82, a trigger safety switch 83, a piezo-resistive pressure sensor 84, a trigger circuit 85, and a voltage source provided by the power source 25. Before the operator can apply pressure to the trigger 82, pressure must first be applied to the trigger safety switch 83. FIG. 3 illustrates that the trigger safety switch 83 completes the connection of the piezo-resistive pressure sensor 84 to the trigger circuit 85 and the control processor 31. The amount of pressure exerted on the trigger 82, and therefore, on the piezo-resistive pressure sensor 84, determines the resistance of the sensor 84 and the magnitude of the voltage drop across the piezo-resistive sensor 84. The trigger circuit 85 sends a signal to the weapon control processor 31 indicating the voltage drop. The weapon control processor 31 converts the voltage drop to a numerical value which is displayed as the trigger pressure bar graph 76 on the LCD display 47.

The detonation trigger pressure is programmable by the operator through the keyboard 44 of the weapon system operator interface area 62. If the weapon system is programmed to fire with less trigger pressure, the trigger detonation mark "T" 75 will be displayed farther to the left on the LCD display 47, thus visually indicating the relative amount of trigger pressure required to fire a round (see FIG. 6).

The bar graph 76 increases left-to-right in proportion to the pressure applied to the trigger 82 and the pressure sensor 84. When the tip of the bar graph 76 reaches the trigger detonation mark 75, the weapon system activates the high frequency A.C. power generator 49 (FIG. 3), and if both the front and rear grip safety switches 51 and 52 are active (closed), indicating that the handgun 11 is properly held, the weapon fires.

The control processor 31 may also be programmed to provide the operator with an audio trigger feedback signal if desired. The control processor 31 generates a low frequency tone through the acoustic transducer 43. As more trigger pressure is applied, the frequency of the tone audibly increases in frequency proportional to the pressure applied. Trigger audio feedback may be disabled by the operator if it is not desired.

The requirement that the trigger safety switch 83 be closed in order for the trigger signal to reach the trigger circuit 85 prevents the weapon from discharging if it is accidentally dropped or jarred. Forward grip safety switch 51 and rear grip safety switch 52 must also be closed for the weapon to fire. The grip switches 51 and 52 are electrically connected in series with the power frequency generator 49, and both must be closed before the weapon will fire. This arrangement prevents the weapon from being fired if it is not properly held.

The handgun of the present invention may also be equipped with a laser target designator 86 (FIG. 3). When the trigger safety switch 83 is active (closed), the weapon system control processor 31 turns on the laser target designator 86 if previously programmed to do so, and the "LAZ" indicator 73 will blink on the LCD display 47 indicating that the laser target designator 86 is lasing. The LAZ indicator 73 will not be displayed if the weapon system was previously programmed to disable laser operation.

The rounds remaining indicator 78 on the LCD display 47 is updated by the weapon system control processor 31 to reflect the number of cartridges remaining in the magazine 91 as each round is fired. Referring again to FIG. 1, a mechanism for determining the number of cartridges remaining in the magazine 9 is disclosed. Cartridge magazine 91 includes a permanent magnet 92 mounted on the top rung of magazine spring 93. It can be seen that, as each cartridge is fired and expelled from the ejection port 15, the magnet 92 advances upward a distance equivalent to the diameter of one cartridge. A number of Hall-effect switches 94 are surface mounted to a single flexible mylar substrate 95 in the hollow handle 96 of the handgun 11. The number of Hall-effect switches 94 is equal to the number of cartridges to be counted, and the switches 94 are positioned one cartridge diameter apart at positions where the magnet 92 will be located directly adjacent to a switch 94 as each round is fired. When the positive field of the magnet 92 is directly over any Hall-effect switch 94, that switch is activated, and a signal is sent to the weapon control processor 31. The processor 31 then updates the rounds remaining indicator 78 on the LCD display 47.

Figure 6:
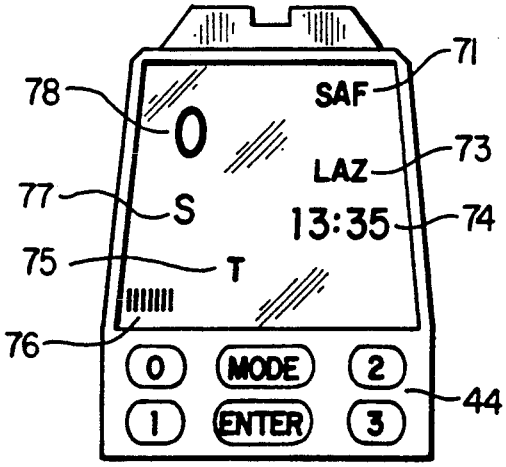
FIG. 6 is an illustration of the operator interface panel showing typical information displayed on the weapon system display panel when the weapon system is safe.

FIG. 6 is an illustration of the operator interface area 62 showing typical information displayed on the weapon system LCD display 47 when the weapon system is safe. A digital key lock, maintaining the weapon in a safe condition, is achieved by requiring the operator to type in a unique multi-digit code into the keyboard. Audio and visual feedback is provided to the operator by the control processor 31 as each key is pressed. Only when the exact combination is entered will the control processor 31 respond to fire control inputs.

Figure 7:
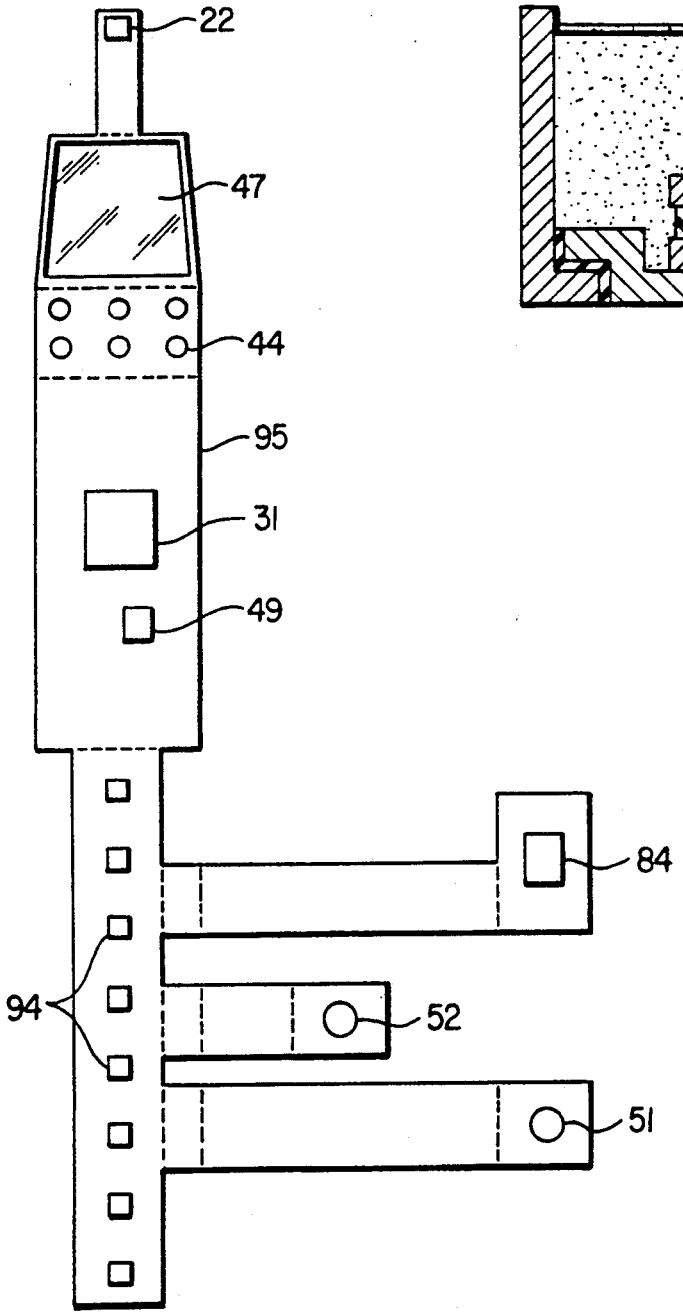
FIG. 7 is an illustrative representation of the electronic components of the weapon system of the present invention fabricated on a single mylar substrate.

Referring next to FIG. 7, it can be seen that the entire weapon system circuitry may be fabricated on a single piece of specially die-out and folded mylar substrate 95. The weapon system control processor 31 and power frequency generator 49, Hall-effect rounds-counting switches 94, Hall-effect breech-open switch 22, and piezo-resistive trigger sensor 84 are surface mounted to the substrate 95. Electrical conductors may be etched onto the mylar substrate, therefore no wiring is needed to connect the various components of the weapon system. The substrate may be folded where indicated by dotted lines in order to fit within the handgun 11 as depicted in the described embodiment. The LCD display 47 and acoustic transducer 43 are also surface mounted to the front and back, respectively, of the mylar substrate 95. The keyboard 44, rear safety switch 52, and front safety switch 51 may be fabricated with additional layers of mylar using "polydome" technology for tactile feedback.

Figure 8:
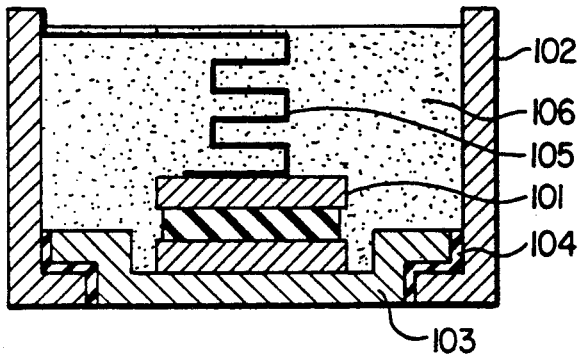
FIG. 8 is an illustration of the components of the high frequency A.C. ignitable primer located in a round of ammunition suitable for use with the weapon system of the present invention.

The weapon system of the present invention may be constructed so that the signal from the power frequency generator 49 (FIG. 3) is used to either actuate a mechanical firing pin for use with industry standard ammunition, or the signal may be used to energize a high frequency A.C. ignitable primer 54. FIG. 8 is an illustration of the components of a high frequency A.C. ignitable primer 54 located in a round of ammunition suitable for use with the weapon system of the present invention. A low value capacitor 101 is used to filter low frequency signals since only high frequencies will pass through a low value capacitor. When primer body 102 is connected to ground, and a high frequency A.C. current is applied to primer base 103, which is insulated from primer body 102 by a mylar film 104, the signal passes through surface mounted capacitor 101 and through resistive tungsten filament 105. Resistive filament 105 is heated by the current, thus igniting explosive compound 106. If the frequency of the signal is too low, such as, for example, 60 Hz, no current will flow, and the primer 54 will not fire the round. Therefore a 60-Hz A.C. source, such as that from a standard wall socket, cannot be used to ignite a round of ammunition. Also, since an A.C. source is required, a D.C. battery cannot be used to ignite ammunition from the present invention. Thus, additional safety features are realized.

Figure 9:
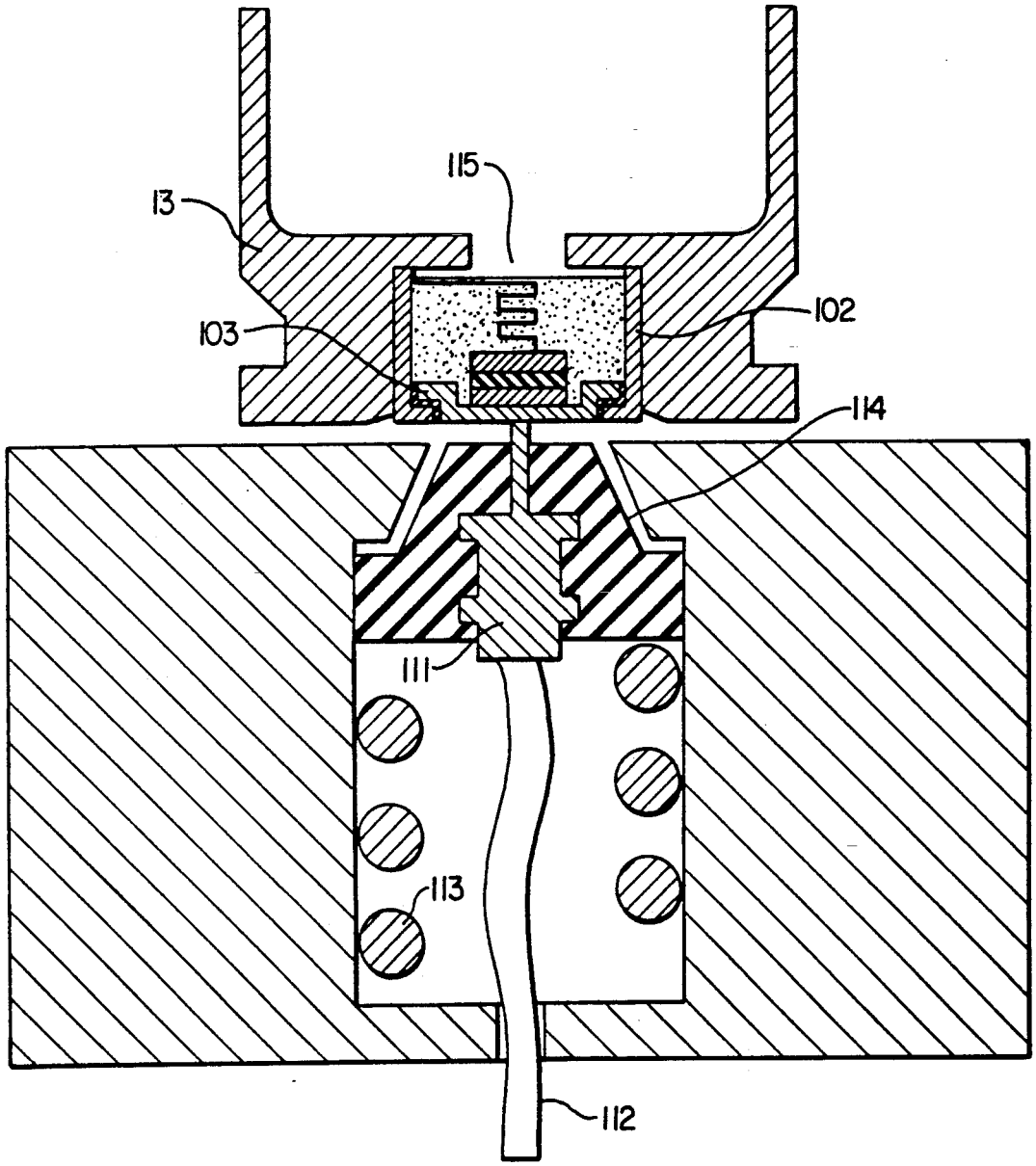
FIG. 9 is a partial cross-sectional view of a round of ammunition suitable for use with the weapon system of the present invention, and engaged with the weapon system firing mechanism.

FIG. 9 is a partial cross-sectional view of a round of ammunition suitable for use with the weapon system of the present invention, and engaged with the weapon system electrical firing mechanism 53. A cartridge 13 is equipped with an A.C. ignitable primer 54 having a primer body 102 which maintains the same form factor as conventional impact primers in order to facilitate retrofitting to existing cartridge casings. From FIG. 2, it can be seen that when the round is chambered and ready for firing, the cartridge casing 13 is in contact with the barrel 12 of the handgun 11. If the barrel 12 and gun frame 19 are electrical ground, the cartridge casing 13 and primer body 102 are also electrical ground. A high frequency A.C. signal is transmitted from the power frequency generator 49 (FIG. 3) to a titanium electrical contact 111 via an insulated conductor 112 causing the signal to propagate through the primer base 103. FIG. 9 illustrates that a spring 113 presses against a non-conductive pin holder 114 which in turn maintains contact with chambered primer base 103. When the primer 54 is ignited, its explosion discharges through an exhaust port 115, igniting powder in the cartridge 13, and firing the round.

It is thus believed that the operation and construction of the present invention will be apparent from the foregoing description. While the method, apparatus and system shown and described has been characterized as being preferred, it will be readily apparent that various changes and modifications could be made therein without departing from the spirit and scope of the invention as defined in the following claims.

What is claimed is:

1. A personal weapon system comprising a firearm, said firearm comprising:

a plurality of sensors for performing various functions, said sensors located at various positions within said firearm, and including:

a real-time clock for providing time and date information; and a Hall-effect compass for providing muzzle-pointing azimuth information;

means for controlling the functions of said sensors, said controlling means including a microprocessor;

means for communicating the output of said sensors to said controlling means;

an operator input device for programming said controlling means, said operator input device including a keyboard;

a liquid crystal display for communicating said sensor outputs to an operator;

a non-volatile memory device for storing said sensor outputs, said non-volatile memory device including an electrically erasable, programmable, read only memory (EEPROM).

2. A personal weapon system comprising a firearm, said firearm comprising:

a plurality of sensors for performing various functions, said sensors located at various positions within said firearm;

means for controlling the functions of said sensors, said controlling means including a microprocessor;

means for communicating the output of said sensors to said controlling means;

an operator input device for programming said controlling means, said operator input device including a keyboard;

a liquid crystal display for communicating said sensor outputs to an operator;

an internal digital security lock which is activated by an operator by the entry of a digital security code through said keyboard, said security lock comprising:

a memory device for storing the digits of said digital security code;

means for comparing said stored security code digits and said operator-entered security code digits; and means for activating said firearm when said stored security code digits and said operator-entered security code digits are the same;

a piezo-resistive trigger assembly, said trigger assembly comprising:

a trigger having front and rear surfaces;

a piezo-resistive pressure sensor mounted behind said trigger, said rear surface of said trigger exerting pressure on said pressure sensor when said trigger is squeezed by an operator;

a voltage source providing a voltage drop across said pressure sensor; and a trigger safety switch mounted upon said front surface of said trigger and connecting said voltage source to said microprocessor when said safety switch is squeezed by an operator; and means for calculating a trigger pressure bar graph, said trigger pressure bar graph being proportional to said voltage drop across said pressure sensor, and being displayed on said liquid crystal display.

3. The microprocessor-controlled firearm of claim 2 wherein said firearm includes means for programming said microprocessor to fire said firearm at differing levels of pressure on said piezo-resistive trigger assembly.

4. The microprocessor-controlled firearm of claim 3 wherein said firearm includes means for displaying to an operator the trigger pressure remaining until said firearm fires.

5. A personal weapon system comprising:

a firearm controlled by a microprocessor and comprising:

means within said firearm for storing a plurality of rounds of ammunition;

means for firing said rounds of ammunition;

means connected to said microprocessor for providing time and date information;

means connected to said microprocessor for providing muzzle-pointing azimuth information; and means for recording said time and date information and said muzzle-pointing azimuth information for each of said rounds of ammunition fired from said firearm.

6. The personal weapon system of claim 5 wherein said means for providing muzzle-pointing azimuth information includes a Hall-effect compass connected to said microprocessor.

7. The personal weapon system of claim 5 wherein said means for recording said time and date information and said muzzle-pointing azimuth information for each of said rounds of ammunition fired includes an electrically erasable, programmable, read only memory (EEPROM).

8. The personal weapon system of claim 5 wherein said means for storing a plurality of rounds of ammunition includes:

a hollow handle of said firearm; and a multiple-round ammunition magazine loaded within said hollow handle.

9. The personal weapon system of claim 8 further comprising a means for counting said rounds of ammunition within said storage means.

10. The personal weapon system of claim 9 wherein said means for counting said rounds of ammunition includes:

a spring mounted in said ammunition magazine, said magazine spring having a top rung for supporting said rounds of ammunition;

a permanent magnet mounted on said top rung of said magazine spring;

a plurality of Hall-effect switches mounted in said hollow handle of said firearm in locations such that as each of said rounds of ammunition is removed from said magazine, said permanent magnet is positioned adjacent one of said Hall-effect switches, thereby activating said switch; and means for signalling said microprocessor which of said Hall-effect switches is activated.

11. The personal weapon system of claim 5 wherein said means for firing said rounds of ammunition includes:

a fire control signal generator for generating a high frequency alternating current (A.C.) firing signal, said signal generator comprising:

a power frequency generator;

an electrical firing mechanism applying said A.C. firing signal to said round of ammunition; and an A.C. ignitable primer in said round of ammunition.

12. The personal weapon system of claim 11 wherein said fire control signal generator includes:

a front grip safety switch connected in series with said power frequency generator; and a rear grip safety switch connected in series with said front grip safety switch and said power frequency generator.

13. The personal weapon system of claim 12 wherein said means for providing time and date information includes a real-time clock mechanism connected to said microprocessor.

14. A microprocessor-controlled handgun having a plurality of rounds of ammunition, a rear side having an upper portion, and an internal microprocessor, said handgun comprising:

a blow-forward barrel which is propelled forward by exploding gases and friction from one of said rounds of ammunition as it travels through said barrel; and an operator interface area forming the upper portion of said rear side of said handgun, said interface area comprising:

a keyboard having a plurality of keys for operator interface with said internal microprocessor; and a liquid crystal display which displays the number of said rounds of ammunition remaining in said handgun, muzzle-pointing azimuth information, time of day, and a trigger-pressure bar graph generated by said internal microprocessor to the operator of said handgun.

15. The microprocessor-controlled handgun of claim 14 further comprising a real-time clock for generating time and data information to be displayed by said microprocessor on said liquid crystal display.

16. A microprocessor-controlled handgun having a plurality of rounds of ammunition, a rear side having an upper portion, and an internal microprocessor, said handgun comprising:

a blow-forward barrel which is propelled forward by exploding gases and friction from one of said rounds of ammunition as it travels through said barrel;

an operator interface area forming the upper portion of said rear side of said handgun, said interface area comprising:

a keyboard for operator interface with said internal microprocessor; and a liquid crystal display for displaying information, generated by said internal microprocessor, to the operator of said handgun;

a real-time clock for generating time and date information to be displayed by said microprocessor on said liquid crystal display; and a directional compass for generating muzzle-pointing azimuth information to be displayed by said microprocessor on said liquid crystal display.

17. The microprocessor-controlled handgun of claim 16 further comprising a firing-parameter memory device for storing said time and date information and said muzzle-pointing azimuth information for each of said rounds fired from said handgun.

18. The microprocessor-controlled handgun of claim 17 further comprising an internal digital security lock which is activated by the operator's entry on said keyboard of a digital security code, said security lock comprising:

a memory device for storing the digits of said digital security code;

means for comparing said stored security code digits and said operator-entered security code digits; and means for activating said handgun when said stored security code digits and said operator-entered security code digits are the same.

19. A microprocessor-controlled handgun having a plurality of rounds of ammunition, a rear side having an upper portion, and an internal microprocessor, said handgun comprising:

a blow-forward barrel which is propelled forward by exploding gases and friction from one of said rounds of ammunition as it travels through said barrel;

an operator interface area forming the upper portion of said rear side of said handgun, said interface area comprising:

a keyboard for operator interface with said internal microprocessor; and a liquid crystal display for displaying information, generated by said internal microprocessor, to the operator of said handgun; and a piezo-resistive trigger assembly, said assembly comprising:

a trigger having front and rear surfaces;

a piezo-resistive pressure sensor mounted behind said trigger, said rear surface of said trigger exerting pressure on said pressure sensor when said trigger is squeezed by an operator;

a voltage source providing a voltage drop across said pressure sensor; and a trigger safety switch mounted upon said front surface of said trigger and connecting said voltage source to said microprocessor when said safety switch is squeezed by an operator.

20. The microprocessor-controlled handgun of claim 19 wherein said microprocessor includes means for calculating a trigger pressure bar graph, said trigger pressure bar graph being proportional to said voltage drop across said pressure sensor, and being displayed on said LCD display.

21. The microprocessor-controlled handgun of claim 20 wherein said handgun includes means for programming said microprocessor to fire said handgun at differing levels of pressure on said piezo-resistive trigger assembly.

22. The microprocessor-controlled handgun of claim 21 wherein said handgun includes means for displaying to an operator the trigger pressure remaining until said handgun fires.

23. An improved handgun of the type in which a plurality of rounds of ammunition are stored and fired, wherein the improvement comprises:

an internally mounted microprocessor for controlling said handgun;

a real-time clock connected to said microprocessor and providing time and date information thereto;

a Hall-effect compass connected to said microprocessor and providing muzzle-pointing azimuth information thereto;

a Hall-effect rounds counter connected to said microprocessor and providing a count of rounds remaining in said handgun to said microprocessor; and a memory device connected to said microprocessor and recording said time and date information and said muzzle-pointing azimuth information for each of said rounds fired from said handgun.

* * * * *